US009434539B2

(12) United States Patent
Boesch

(10) Patent No.: US 9,434,539 B2
(45) Date of Patent: Sep. 6, 2016

(54) COVER FOR CONTAINER

(71) Applicant: TB Industries Inc., St. Michael, MN (US)

(72) Inventor: Timothy Richard Boesch, Otsego, MN (US)

(73) Assignee: TB Industries Inc., St. Michael, MN (US)

( * ) Notice: Subject to any disclaimer, the term of this patent is extended or adjusted under 35 U.S.C. 154(b) by 0 days.

(21) Appl. No.: 14/600,740

(22) Filed: Jan. 20, 2015

(65) Prior Publication Data

US 2015/0203293 A1 Jul. 23, 2015

Related U.S. Application Data

(60) Provisional application No. 61/929,466, filed on Jan. 20, 2014.

(51) Int. Cl.

| | |
|---|---|
| ***B65F 1/14*** | (2006.01) |
| ***B65D 43/12*** | (2006.01) |
| ***B65D 43/20*** | (2006.01) |
| ***B65D 90/58*** | (2006.01) |
| *B65F 1/16* | (2006.01) |
| *B65D 90/62* | (2006.01) |

(52) U.S. Cl.

CPC ..... *B65F 1/1623* (2013.01); *B65D 43/12* (2013.01); *B65D 43/20* (2013.01); *B65D 90/58* (2013.01); *B65F 1/16* (2013.01); *B65D 90/623* (2013.01); *B65D 2590/662* (2013.01); *B65F 2001/1653* (2013.01); *B65F 2240/118* (2013.01)

(58) Field of Classification Search

CPC ..... B65F 1/16; B65F 1/1623; B65F 1/1646; B65F 2001/1653; B65F 2240/118; B65D 43/12; B65D 43/20; B65D 43/26; B65D 43/166; B65D 43/167; B65D 43/265; B65D 2251/10; B65D 2251/1066; B65D 2590/662; B65D 51/243; B65D 88/124; B65D 88/126; B65D 90/0046; B65D 90/58; B65D 90/582; B65D 90/62; B65D 90/623; B65D 90/626

USPC ..... 220/345.1

See application file for complete search history.

(56) References Cited

U.S. PATENT DOCUMENTS

| | | | |
|---|---|---|---|
| 2,758,744 | A | 8/1956 | Spindler et al. |
| 3,490,642 | A | 1/1970 | Friedlander |
| 3,961,723 | A | 6/1976 | Eckel |
| 4,821,902 | A | 4/1989 | May |
| 4,853,985 | A | 8/1989 | Perry |
| 4,934,562 | A | 6/1990 | Early et al. |

(Continued)

OTHER PUBLICATIONS

Sschweitzl 995, "Wastequip environmental plastic lid", https://www.youtube.com/watch?v=XeRw7SSGZmQ, Feb. 26, 2011.

(Continued)

*Primary Examiner* — Anthony Stashick
*Assistant Examiner* — Mollie Llewellyn
(74) *Attorney, Agent, or Firm* — Patterson Thuente Pedersen, P.A.

(57) ABSTRACT

The present invention is directed to a cover assemblies for use with containers such as large dumpsters or roll-off containers. The cover assembly generally includes a cover portion, a frame portion, and one or more mounting arms. The cover is coupled to the frame, and the frame is movable with respect to the mounting arm from a first position to a second position, wherein the first position comprises a closed position and wherein the second position comprises an open position.

15 Claims, 16 Drawing Sheets

(56) References Cited

U.S. PATENT DOCUMENTS

| | | | | |
|---|---|---|---|---|
| 4,991,238 | A | 2/1991 | Forrest | |
| 5,011,168 | A | 4/1991 | Deamicis | |
| 5,167,341 | A | 12/1992 | Morton et al. | |
| 5,251,775 | A | 10/1993 | Kruzick et al. | |
| 5,533,643 | A | 7/1996 | Kruzick | |
| 5,755,351 | A | 5/1998 | Kruzick | |
| 6,045,173 | A | 4/2000 | Tiesler et al. | |
| 6,364,153 | B1 * | 4/2002 | Petzitillo, Jr. ..... | B65F 1/16 220/812 |
| 6,364,154 | B2 | 4/2002 | Kruzick et al. | |
| 6,732,883 | B2 | 5/2004 | Petzitillo, Jr. et al. | |
| 7,093,731 | B2 | 8/2006 | Karpisek | |
| 2013/0105486 | A1 * | 5/2013 | Mashburn ..... | B65F 1/06 220/495.06 |

OTHER PUBLICATIONS

Go Green Easy Glide Container Lid, "Going Green Easy Glide Container Lid—Southeastern Fabrications, LLC", https://www.youtube.com/watch?v=Y8vZJ2MqYfs, Feb. 24, 2009.

Confab Consolidated Fabricators Corp., "Ultra EZ-Flip Plastic Roof for Roll-Off", http://www.con-fab.com/ultra-ez-flip-plastic-roofs, dated prior to Jan. 20, 2014.

Confab Consolidated Fabricators Corp., "EZ Side Slide Roll-Off Covers", publication date unknown, accessed Jan. 7, 2016.

* cited by examiner

Fig. 15
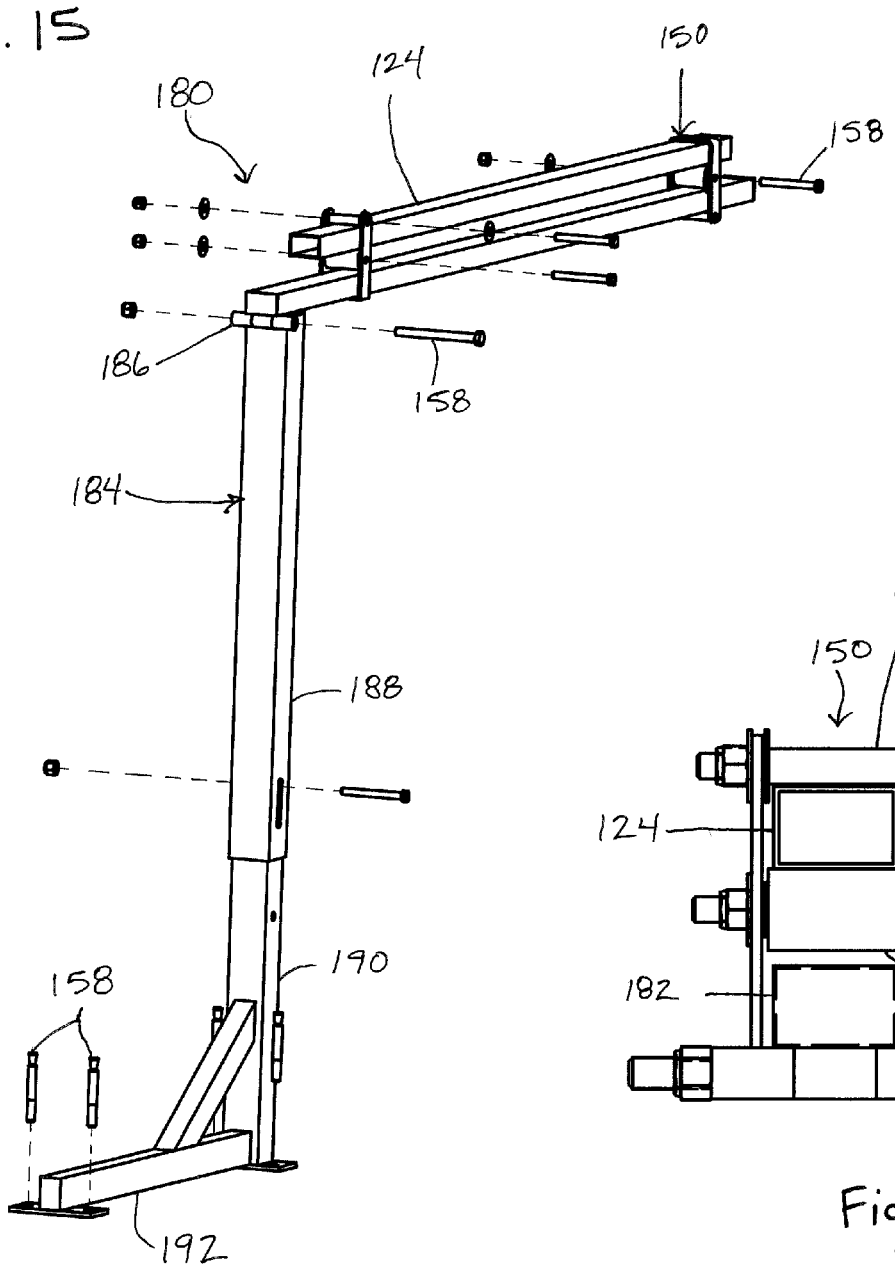
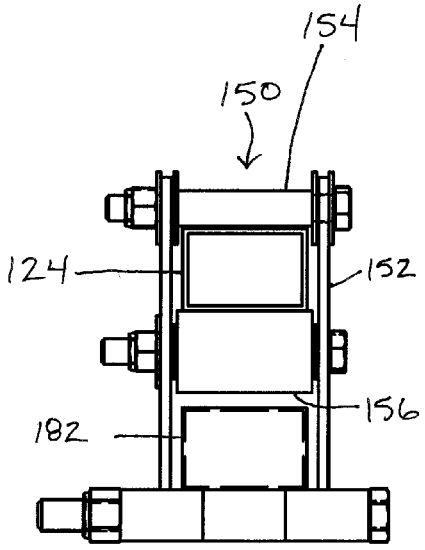
Fig. 16

COVER FOR CONTAINER

CROSS-REFERENCE TO RELATED APPLICATIONS

This application claims the benefit of Provisional Application No. 61/929,466, filed Jan. 20, 2014, titled "Cover for Container," the disclosure of which is hereby incorporated by reference in its entirety.

FIELD OF THE INVENTION

The present invention relates generally to covers for containers. More specifically, the present invention relates to covers for large dumpsters such as used in the construction or manufacturing industries, the covers being easily operable by a single person.

BACKGROUND OF THE INVENTION

In the construction industry, large dumpsters are used to collect and contain debris and waste associated with demolition, renovation and/or construction. One such type of dumpster is referred to as a roll-off container, usually featuring a rectangular footprint so as to be easily transportable by truck. Roll-off containers are configured to be delivered and removed via specialized trucks which allow the container to rolled off the truck and put into place. Such trucks utilize tilting beds, cable and winch systems, and/or hooks in order to facilitate loading and unloading the roll-off container from the truck. Alternately, dumpsters may be delivered and removed via a truck having a crane. These dumpsters are sized according to volume, with common container sizes in the United States being between ten and forty yards.

Construction debris may originate from a building site where something is being built, renovated, or demolished. Roll-off dumpsters are also used for various jobs that need much material to be taken away. The material in the roll-off may be taken to a landfill, recycled or otherwise properly disposed of.

While roll-off containers typically include an open top, in certain applications it may be desirable to cover the container, for example to comply with environmental regulations regarding storm water exposure, to provide protection from theft or unauthorized dumping, and/or to otherwise protect against unwanted or unauthorized access to the container or its contents. One such type of cover may be a tarpaulin, which is inexpensive but can be cumbersome to handle and ineffective at securely protecting the container and its contents. Another type of cover in use is constructed of heavy duty steel, which provides excellent security but is expensive and tremendously heavy, requiring specialized equipment to open and close the cover.

A need exists in the industry for an improved cover for large dumpsters.

SUMMARY OF THE INVENTION

In one embodiment, a cover assembly for a container comprising a frame, a cover coupled to the frame, and an opening mechanism in communication with the frame and including a means for coupling with the container, wherein the cover is configured to be movable between a closed position which substantially covers an opening of the container, and an open position which allows access to a substantial portion of the opening of the container.

In one embodiment, a cover assembly for a container, comprising a frame, a cover coupleable to the frame, and an opening mechanism in communication with the frame and including a support for coupling the cover assembly to a structure separate from the container, wherein the cover is configured to be movable between a closed position which substantially covers an opening of the container, and an open position which allows access to a substantial portion of the opening of the container.

In one embodiment, a kit for a cover assembly comprising a plurality of support struts, the struts configured to be joined together to construct a frame, a cover coupleable to the frame, and an opening mechanism in communication with the frame and including a means for supporting the frame, wherein the cover is configured to be movable between a closed position which substantially covers an opening of a container, and an open position which allows access to a substantial portion of the opening of the container.

BRIEF DESCRIPTION OF THE DRAWINGS

The invention may be more completely understood in consideration of the following detailed description of various embodiments of the invention in connection with the accompanying drawings, in which:

FIG. 15 is a perspective view of a mounting arm and portions of a frame, according to another embodiment of the present invention.

FIG. 16 is an end view of a roller assembly according to the present invention.

Figure 1:
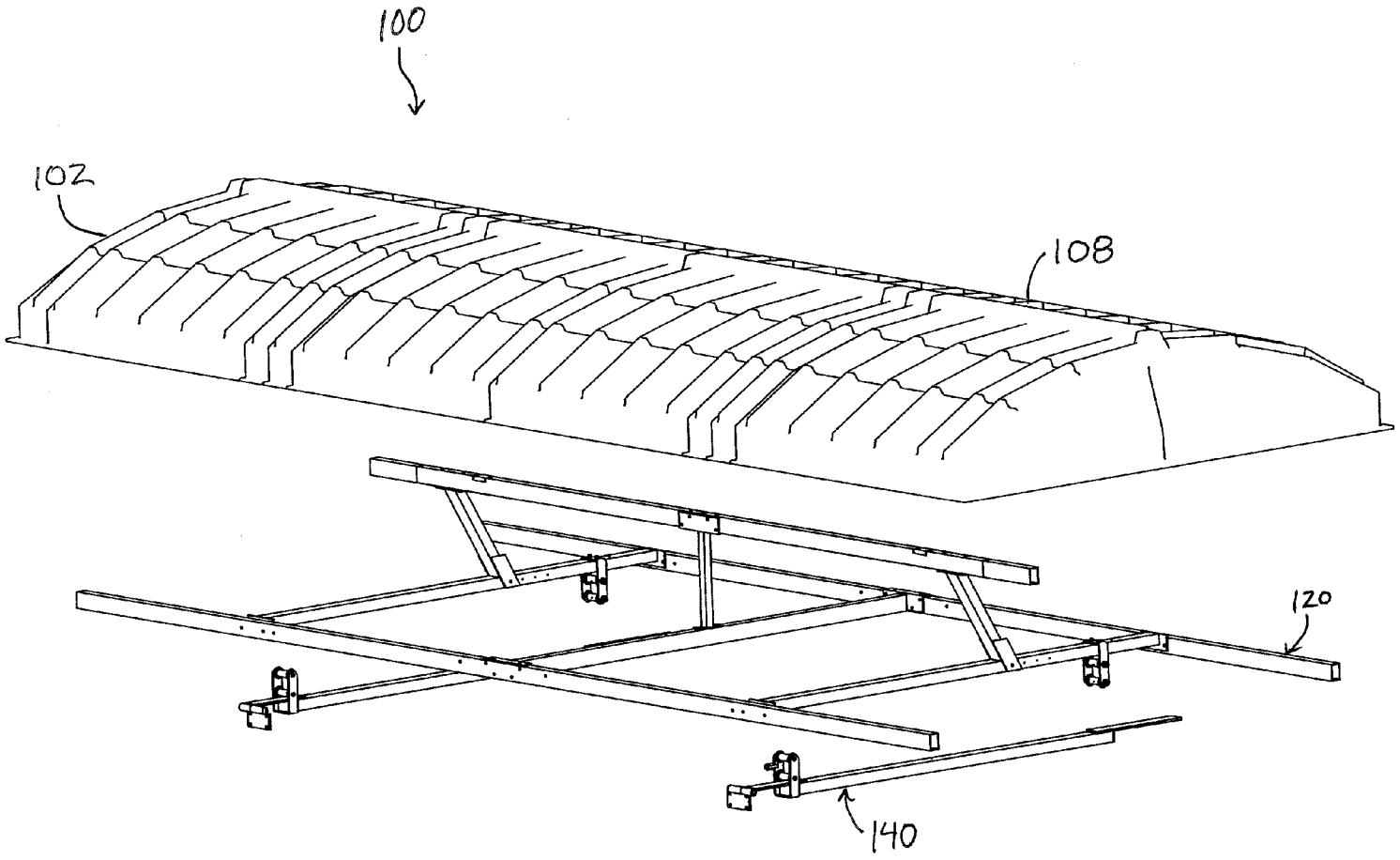
FIG. 1 is an exploded perspective view of a cover assembly according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE INVENTION

The following detailed description should be read with reference to the drawings in which similar elements in different drawings are numbered the same. The drawings, which are not necessarily to scale, depict illustrative embodiments and are not intended to limit the scope of the invention.

Referring generally to the Figures, embodiments of the present invention are directed to a cover assembly 100 for use with an open-top container 170, such as a large dumpster or roll-off container. Cover assembly 100 generally includes a cover portion 102, a frame portion 120, and an opening mechanism 140.

Figure 1A:
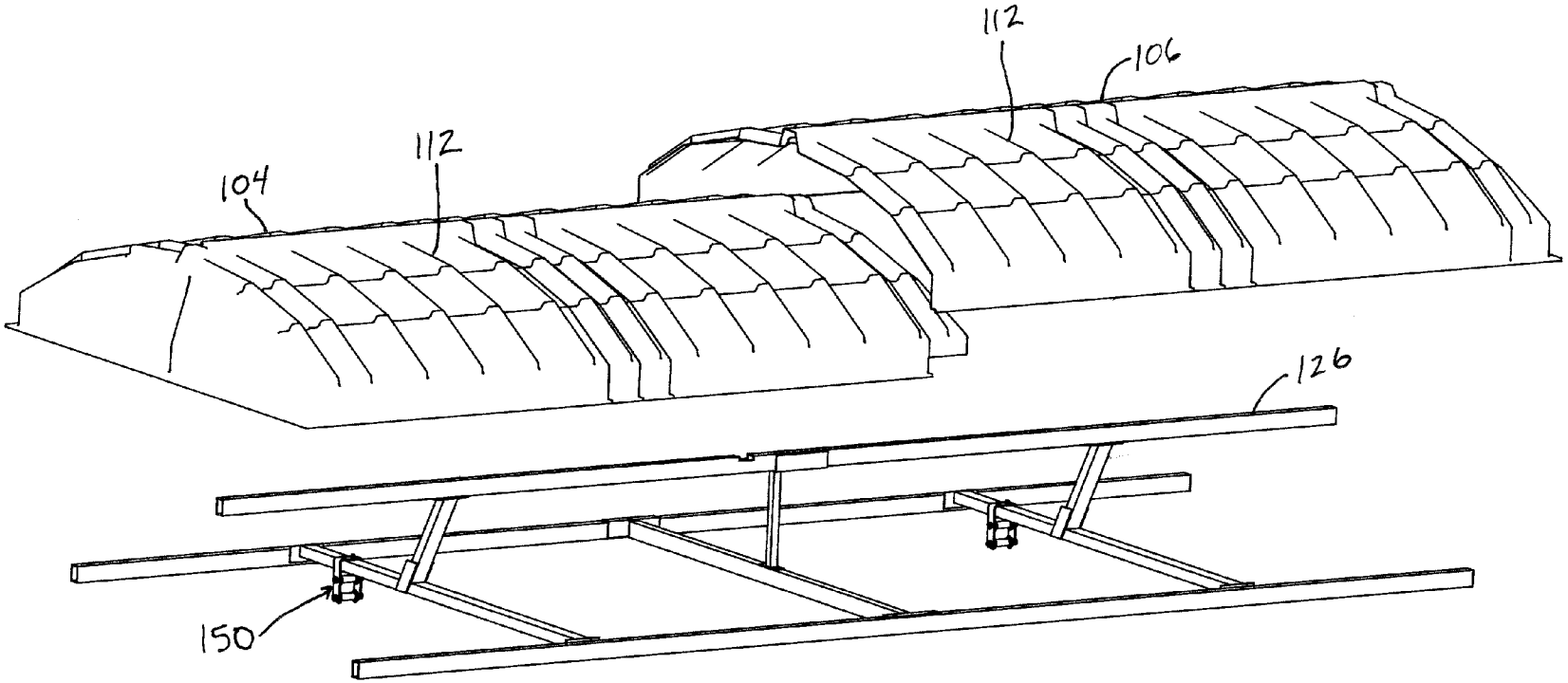
FIG. 1A is an exploded perspective view of portions of a cover assembly according to another embodiment of the present invention.

Cover 102 may be constructed of suitable lightweight yet strong materials such as fiberglass, thin gauge metals such as aluminum or steel, or various plastics. In one embodiment depicted in FIG. 1, cover 102 comprises a single piece. In another embodiment, cover 102 comprises multiple pieces which are joined together to form a large cover, such as depicted in FIG. 1A wherein cover 102 comprises a first part 102 and a second part 104. Cover 102 has an outer surface 108 and an inner surface 110, and may include various ribs, gussets, or other features 112 to increase stiffness. As depicted in the Figures, ribs 112 are disposed on outer surface 108, although ribs or gussets 112 may be included on inner surface 110 in addition to, or in place of, ribs 112 on outer surface 108. Optionally, inner surface 110 of cover 102 may include a reinforcing framework to provide additional stability. Suitable construction techniques for cover 102 may include wet lay-up of fiberglass, stamping of sheet metal in a die, or roto-molding or injection molding for plastics.

Cover assembly 100 also includes a frame 120 configured to support cover 102. As depicted generally in the Figures, frame 120 comprises a plurality of struts, trusses or frame members, in the form of longitudinal rails 122 and lateral crossmembers 124. Additional struts may also be included as necessary to provide suitable strength and rigidity depending upon the desired application. Longitudinal rails 122 are configured to extend along a first, longitudinal direction of container 170, e.g., the length, while crossmembers 124 are configured to space rails 122 apart a distance which corresponds to a second, lateral dimension of the container, e.g., the width. Frame 120 may be constructed of suitable materials such as steel, aluminum, or plastics, especially extruded plastics. Cover 102 may be secured to frame 120 in a number of ways, for example by fastening cover 102 directly to rails 122. Frame 120 may be constructed of smaller individual pieces and configured to be assembled by bolts and/or brackets, in order to allow cover assembly 100 to be shipped more easily and/or at lower cost.

Figure 4:
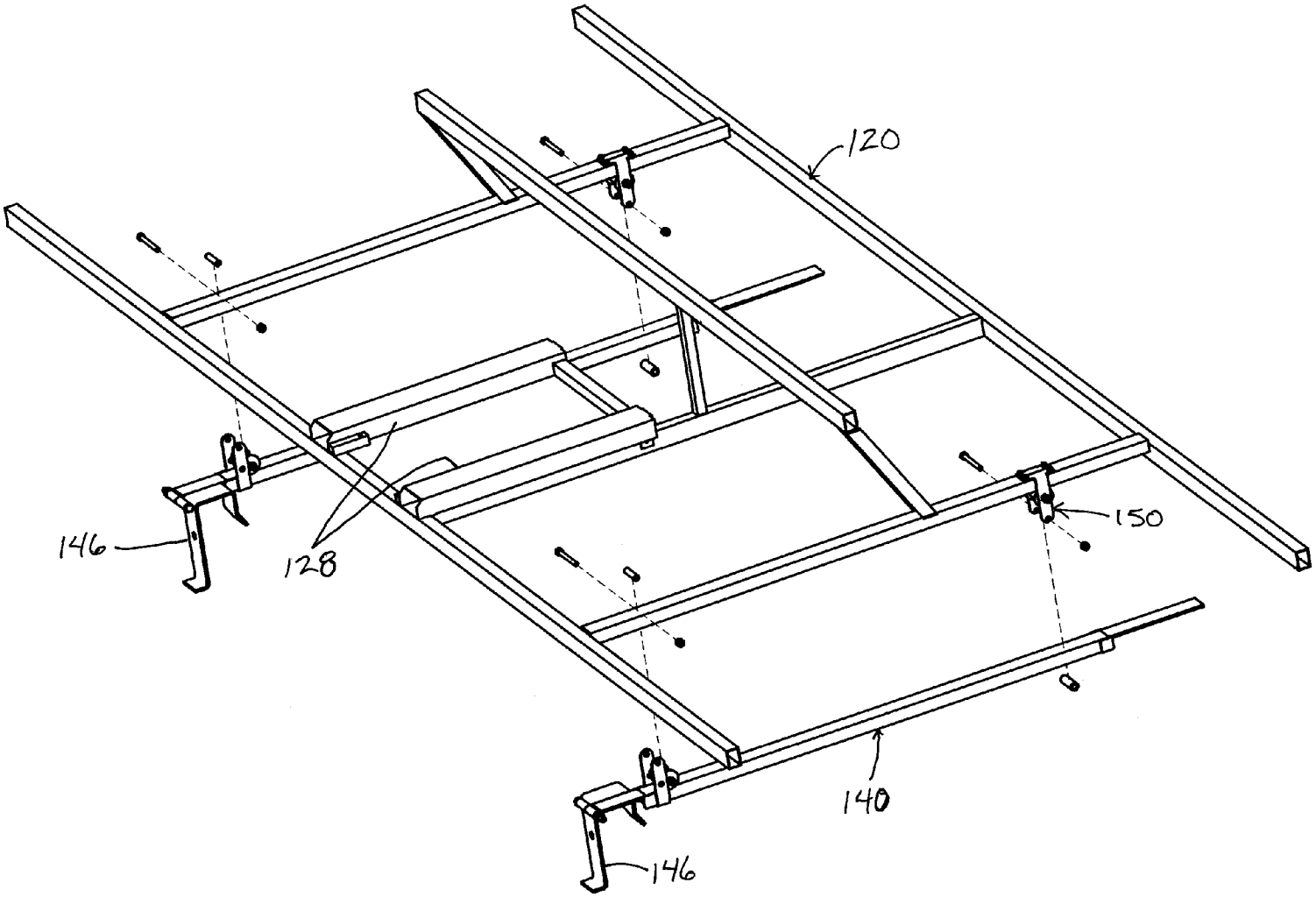
FIG. 4 is an exploded perspective view of portions of a cover assembly according to another embodiment of the present invention.

Frame 120 optionally includes a center standoff support 126, configured to provide support to the peak of cover 102. Center support 126 is suitable for use with covers configured with a tall center portion, while covers having a lower center profile may not require the use of center support 126. Also optionally as depicted in FIG. 4, frame 120 may include a transport means 128, so as to allow cover assembly 100 to be picked up and moved with a forklift or similar device. Further, frame 120 may optionally include a handle (not pictured) to facilitate easier opening and closing of cover 102.

Figure 2:
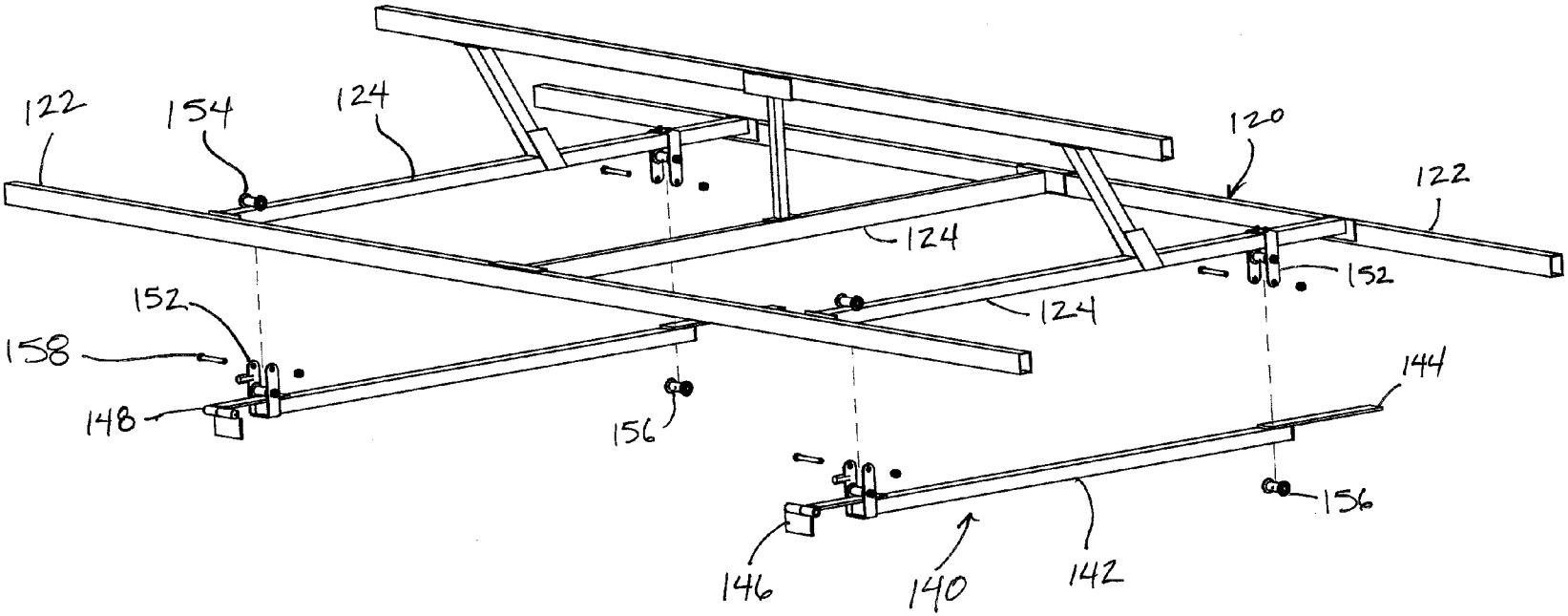
FIG. 2 is an exploded perspective view of portions of the cover assembly of FIG. 1.
Figure 3:
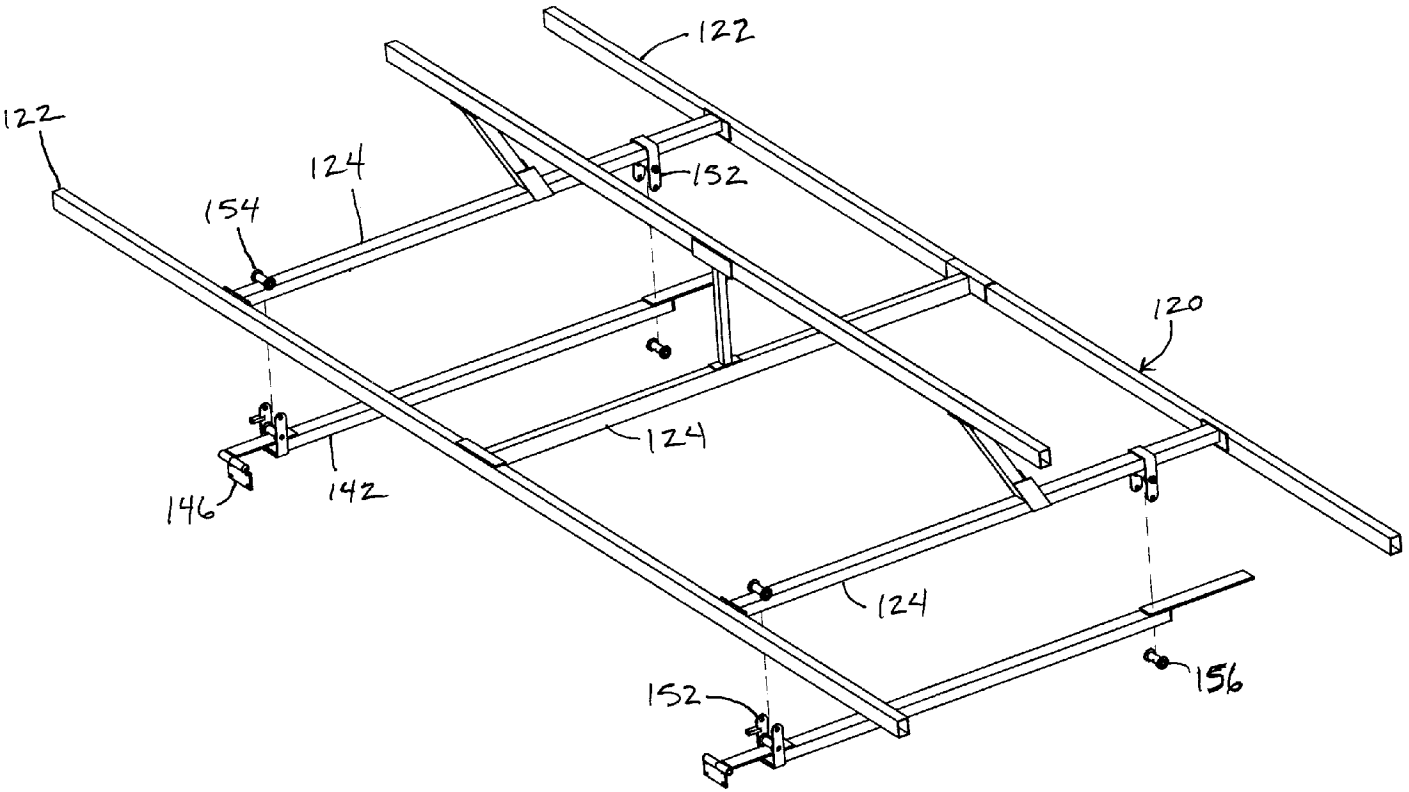
FIG. 3 is an alternate exploded perspective view of FIG. 2.

Cover assembly 100 also includes an opening mechanism 140, configured to facilitate moving cover 102 between a closed position and an open position. Opening mechanism 140 generally includes at least one beam 142 having an optional tip portion 144, a means for coupling 146 to a container, a pivot or hinge 148, and a plurality of roller assemblies 150. As depicted in the Figures, opening mechanism 140 includes a plurality of beams 142, however a single beam 142 may be sufficient for smaller-sized covers. Means for coupling 146 is disposed on a first end of beam 142, and as depicted in FIGS. 1-3 may comprise a bracket which is configured to be bolted directly to container 170. As depicted in FIG. 4, the means for coupling comprises a clamp or shackle which is configured to be removably placed on a side of container 170.

At a second end of beam 142 is an optional tip portion 144 having a thin profile as compared to beam 142. With cover assembly 100 in the closed position, tip portion 144 allows cover 102 to sit nearly flush with an edge of container 170. Tip portion 144 may comprise a separate component secured to beam 142, or beam 142 may be modified to include a thin profile so as to create tip portion 144. In embodiments lacking tip portion 144, beam 142 may rest directly on an edge of container 170.

Roller assembly 150 is configured to provide smooth opening and closing of cover assembly 100, and generally includes a mounting bracket 152, an upper roller 154, and a lower roller 156, secured with suitable fasteners 158. As depicted in FIGS. 1-4 and 7, roller assembly 150 proximate the means for coupling is configured such that mounting bracket 152 is secured to beam 142, upper roller 154 is disposed above crossmember 124, and lower roller 156 is disposed below crossmember 124 and above beam 142. Also as depicted in FIGS. 1-4 and 7, roller assembly 150 proximate tip portion 144 is configured such that mounting bracket 152 is secured to crossmember 124, upper roller 154 is disposed below crossmember 124 and above beam 142, and lower roller 156 is disposed below beam 142.

In another embodiment, frame 120 may be configured to include an opening mechanism and a means for coupling with a container, such that frame 120 is directly coupleable with the container.

Figure 5:
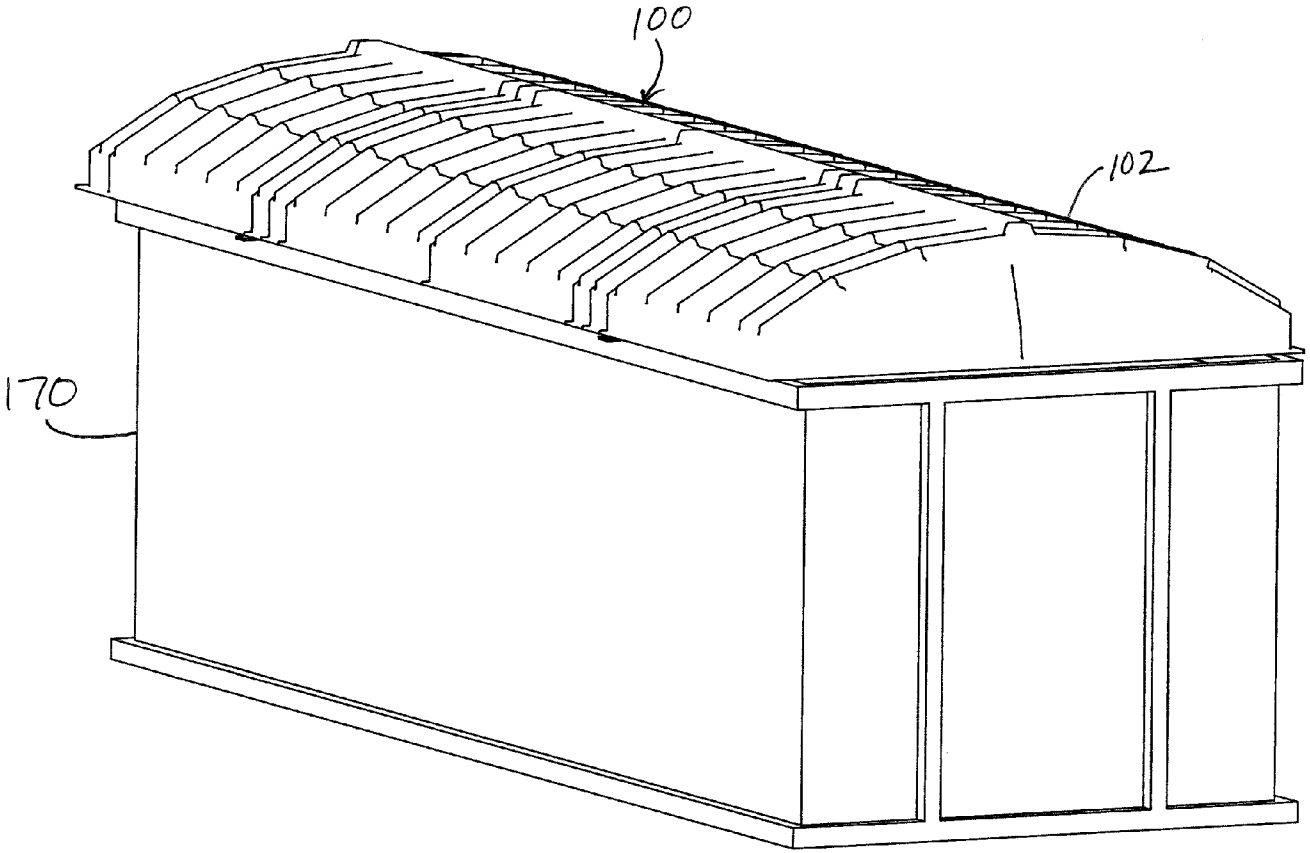
FIG. 5 is a perspective view of a cover assembly in a closed position on a container.
Figure 6:
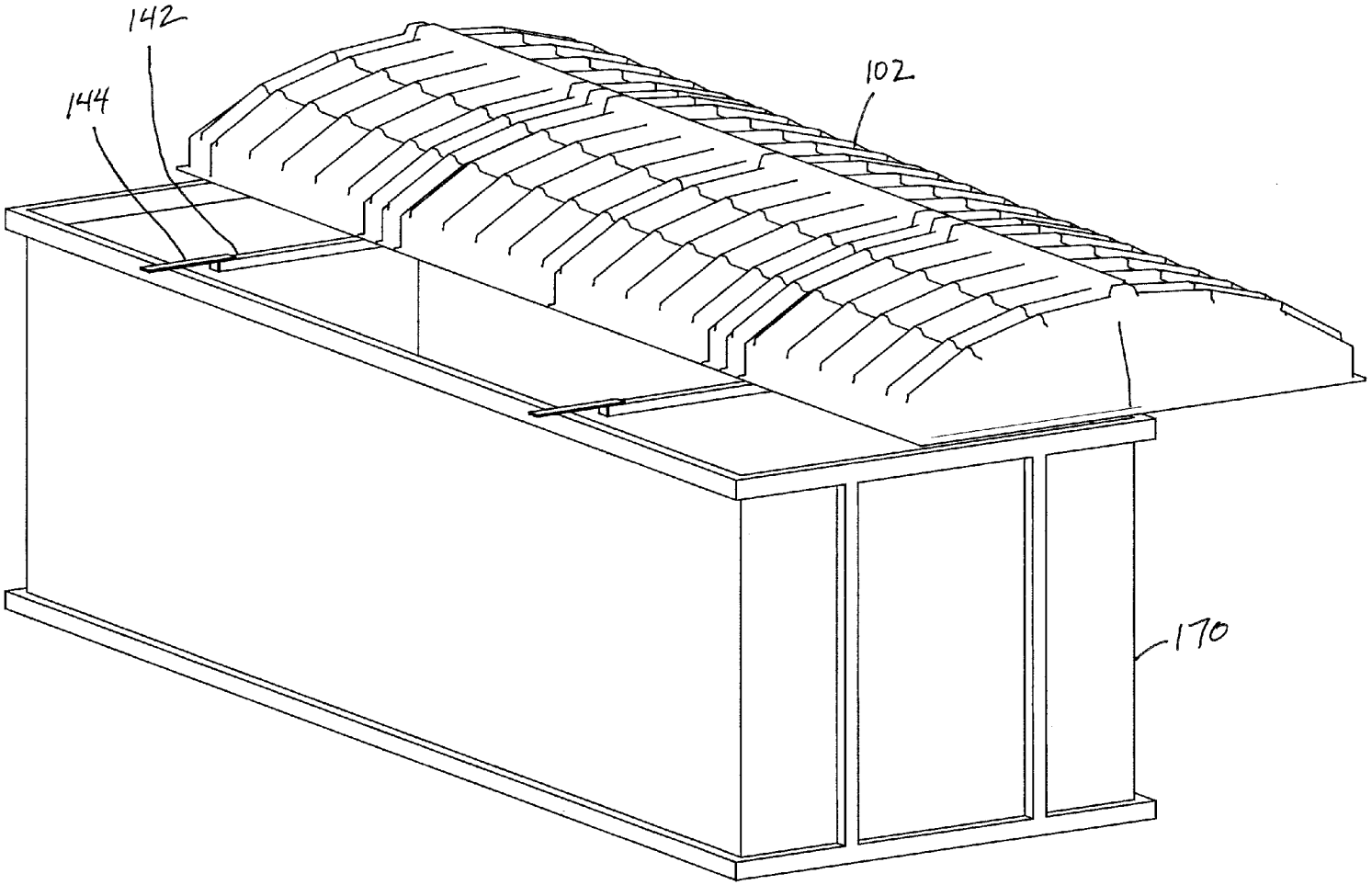
FIG. 6 is a perspective view of a cover assembly on a container with a cover in between a closed position and an open position.

Referring now to the operation of cover assembly 100, FIG. 5 depicts cover assembly 100 in a closed position. An operator pulls or pushes on any of frame 120, cover 102 or handle if equipped, which causes frame 120 and cover 102 to move horizontally with respect to opening mechanism 140. As described above, opening mechanism 140 is secured to container 170 by way of means for coupling 146. Roller assemblies 150 provide smooth operation, allowing a single person to open and close even a large cover. As frame 120 and cover 102 slide horizontally toward an open position, such as in FIG. 6, once the middle of frame 120 and cover 102 are nearing the edge of container 170 (and therefore pivot 148 on opening mechanism 140), frame 120 and cover 102 will begin to be balanced over the pivot point. Continued movement toward the open position will cause frame 120 and cover 102 to move past the pivot point and begin to tilt from a horizontal orientation to a vertical orientation.

Figure 7:
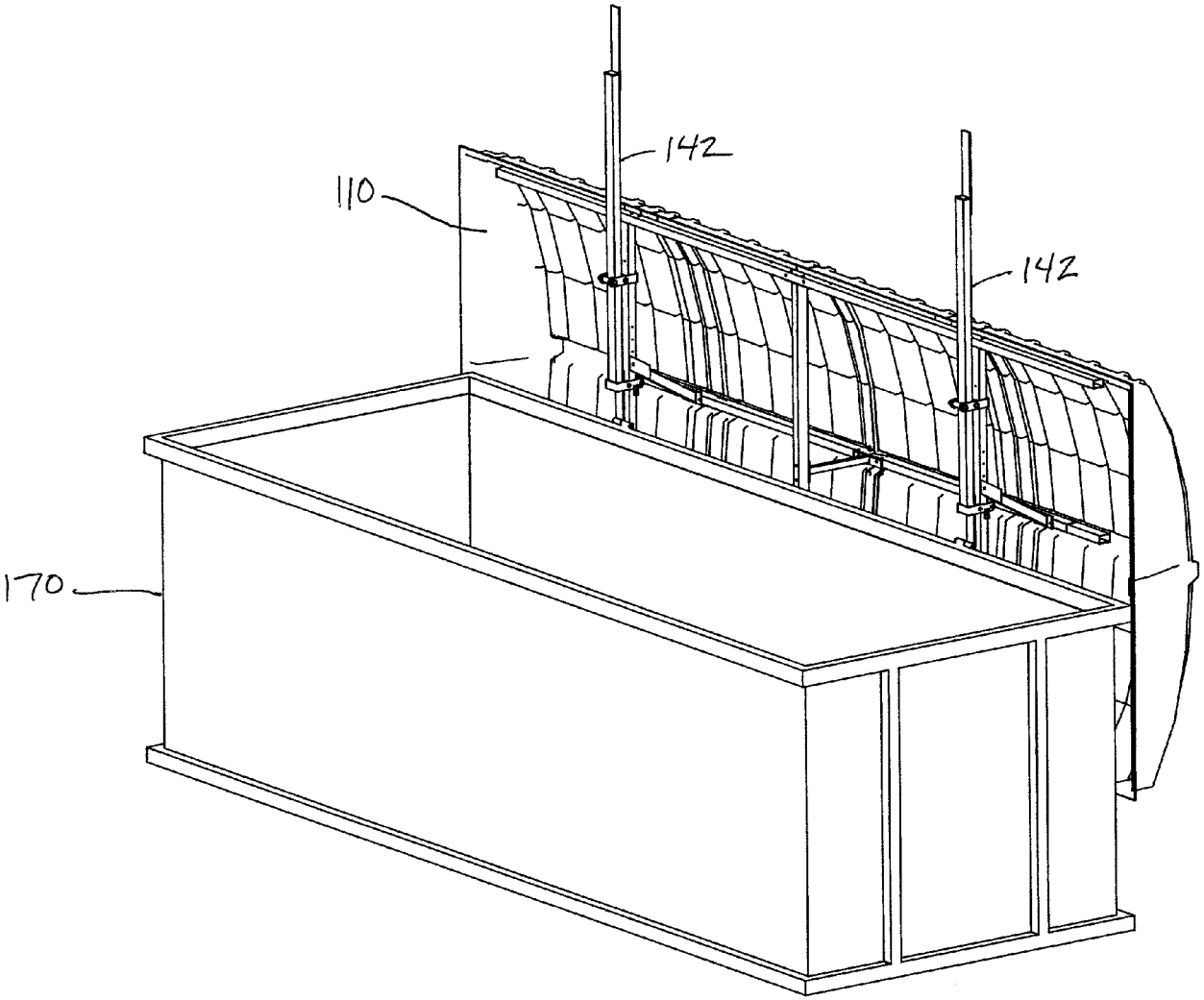
FIG. 7 is a perspective view of a cover assembly with a cover being in an open position on a container.
Figure 8:
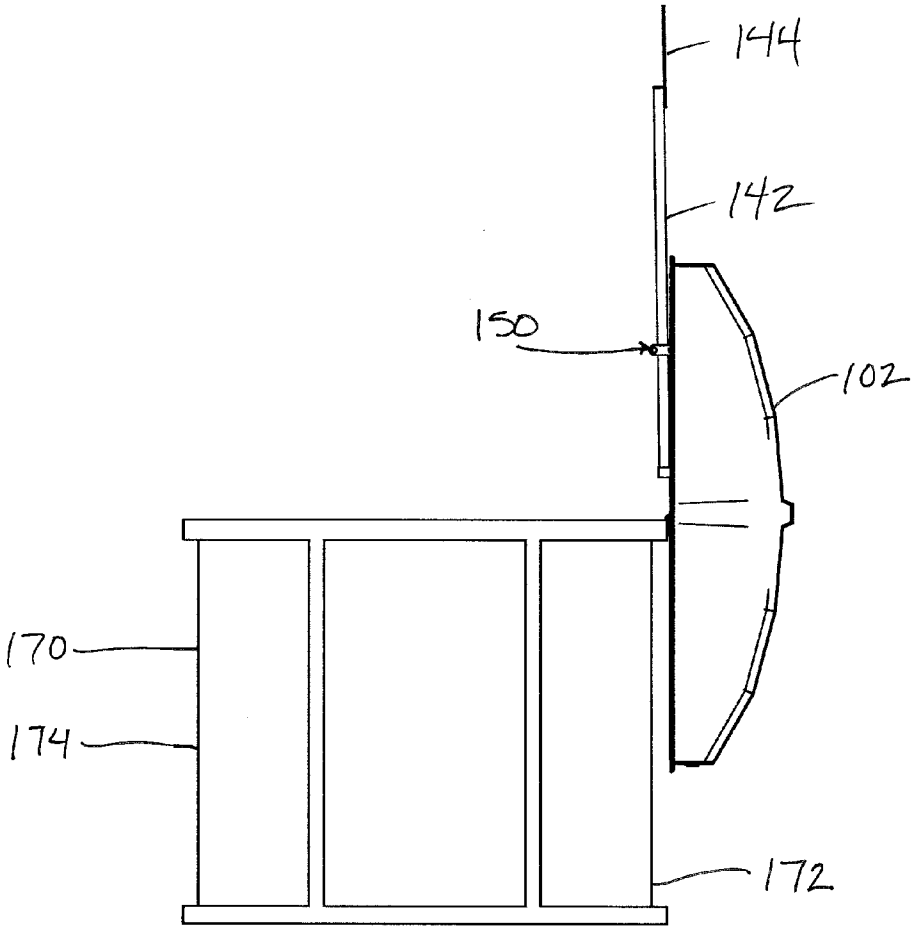
FIG. 8 is an end view of the cover assembly of FIG. 7
Figure 9:
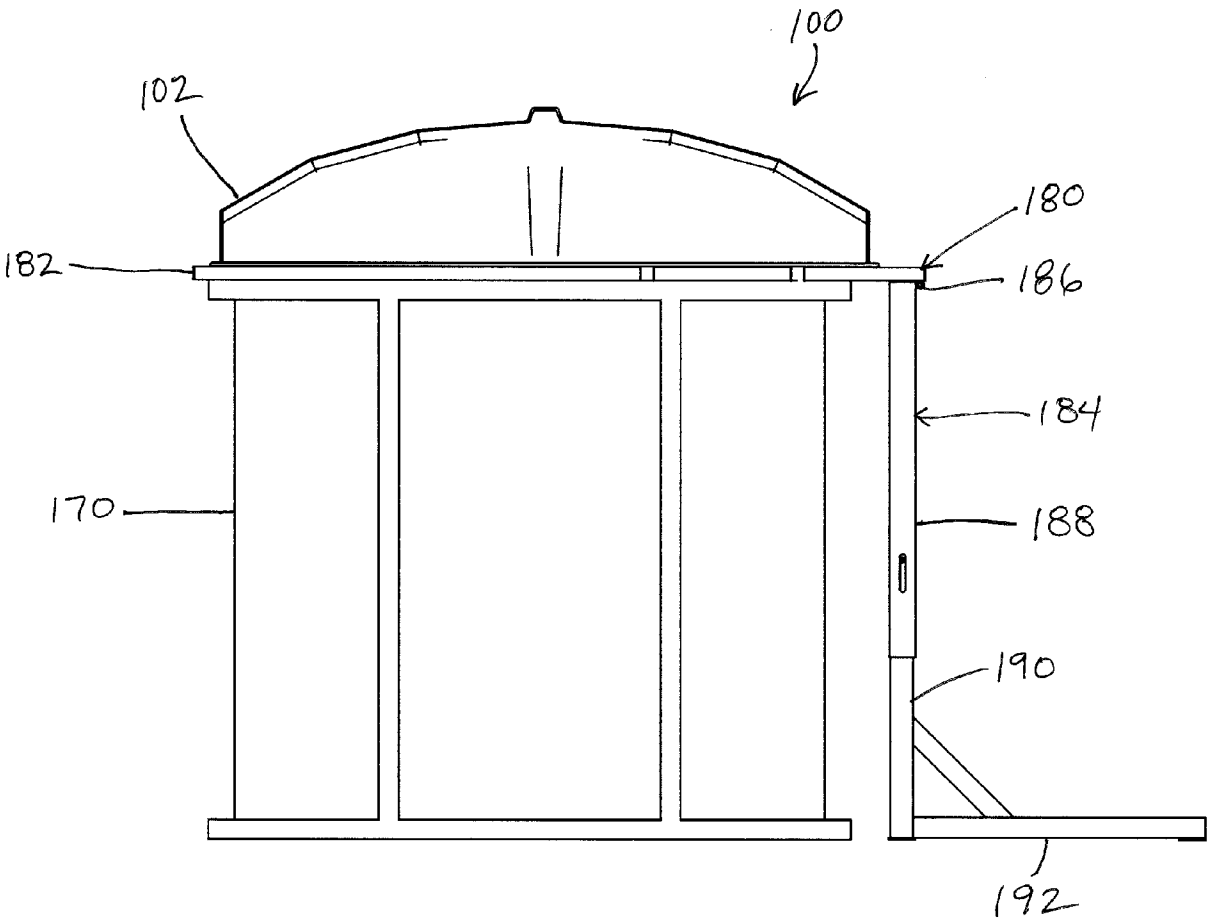
FIG. 9 is an end view of a cover assembly according to another embodiment of the present invention, with a cover in a closed position over a container.
Figure 10:
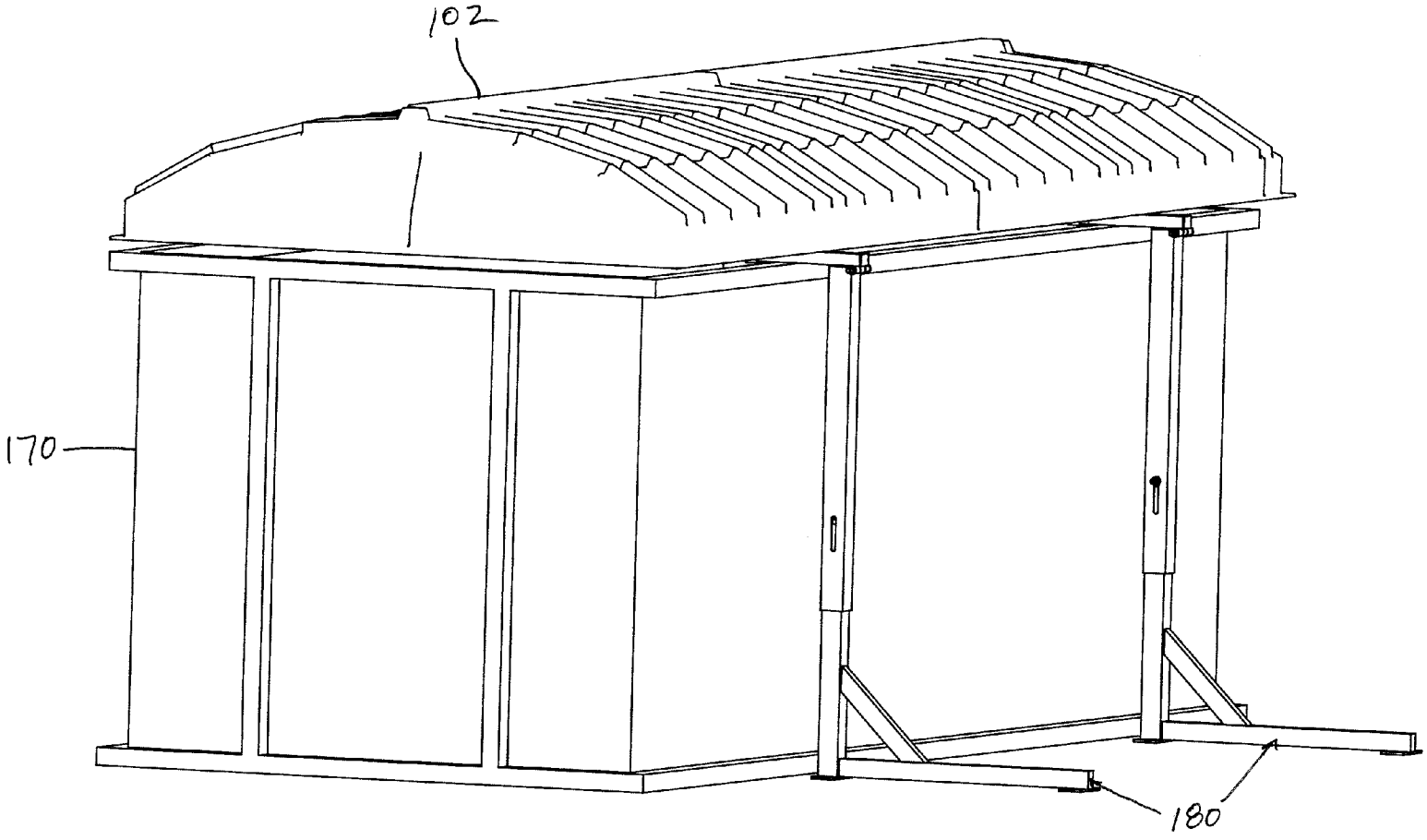
FIG. 10 is a perspective view of the cover assembly of FIG. 9.
Figure 11:
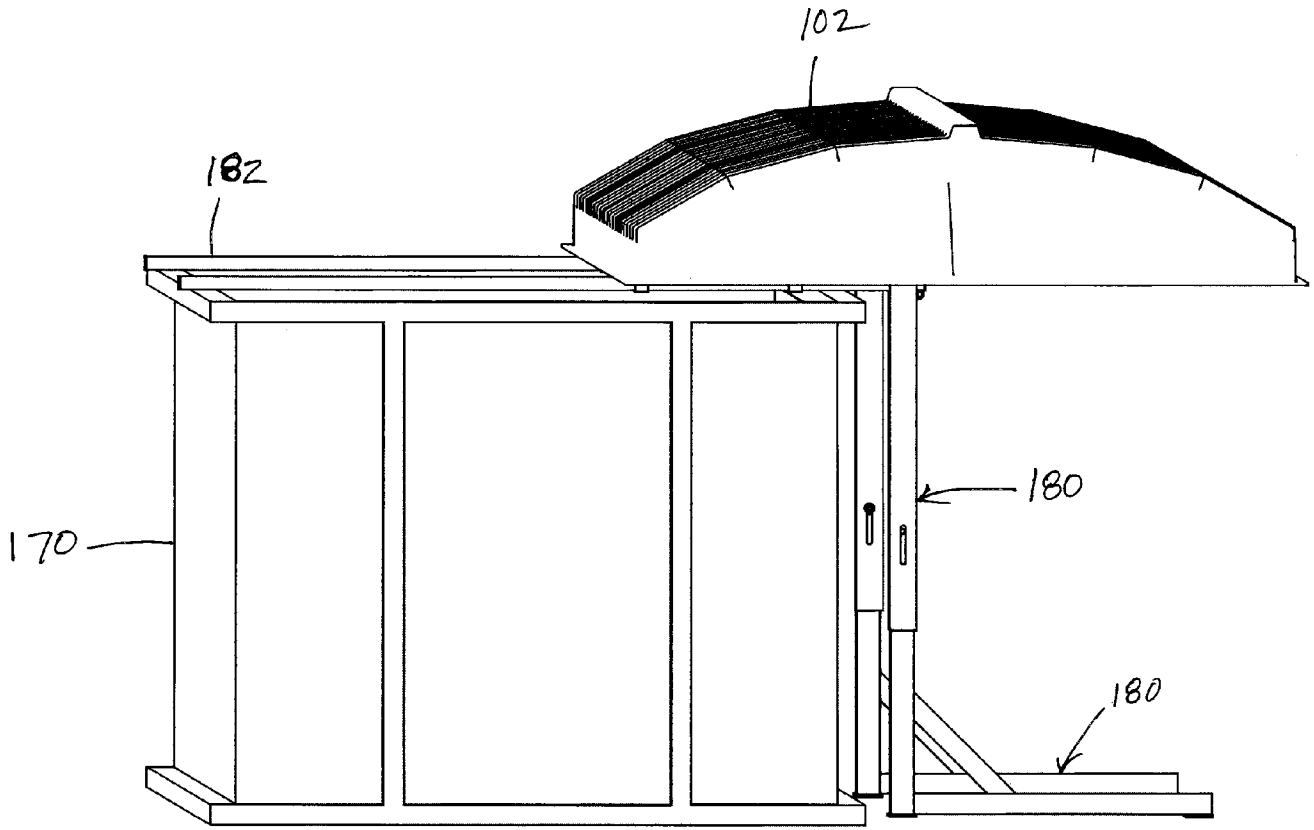
FIG. 11 is an end perspective view of a cover assembly on a container, with a cover in between a closed position and an open position.
Figure 12:
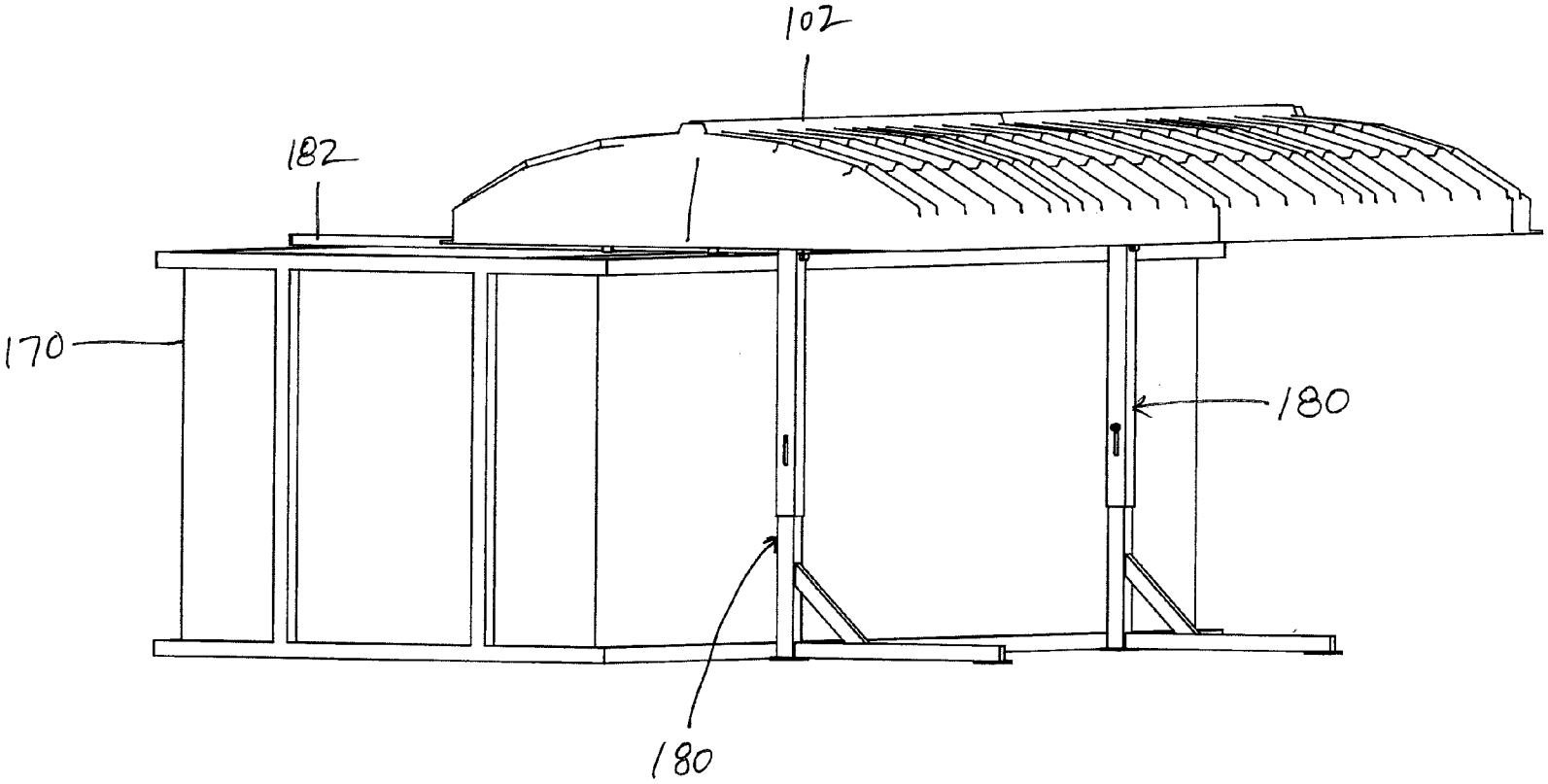
FIG. 12 is another view of the cover assembly of FIG. 11.

FIGS. 7-8 depict cover assembly 100 in a fully open position, with means for coupling 146 of opening mechanism 140 being attached to container 170 but the remainder of cover assembly 100 being out of the way, allowing access to the inside of container 170. Mounting brackets 152 of opening mechanism 140 and the configuration of frame 120 act as stops, preventing frame 120 and cover 102 from sliding off of beams 142 and thereby container 170. Optionally, one or more counterweights may be added to frame 120 and/or handle in order to aid the opening of cover assembly 100.

Referring now to FIGS. 9-16, another embodiment of cover assembly 100 is depicted, having a free-standing opening mechanism 180 configured to be coupled to the ground or other suitable structure. Opening mechanism 180 generally includes a beam 182 pivotably coupled to a vertical support 184 via pivot 186, and a base 192. Support 184 may be height adjustable to facilitate usage with containers of varying sizes, and support 184 may include a first portion 188 adjustably coupleable to a second portion 190 at a plurality of different positions and secured with suitable fasteners. Collectively, means for coupling 146 described above and support 184 may constitute a means for supporting frame 120 and/or cover 102.

As best depicted in FIGS. 15-16, each roller assembly 150 is configured such that mounting bracket 152 is secured to beam 142, upper roller 154 is disposed above crossmember 124, and lower roller 156 is disposed below crossmember 124 and above beam 142. Alternately, upper roller 154 may be omitted and simply comprise a bolt.

Figure 13:
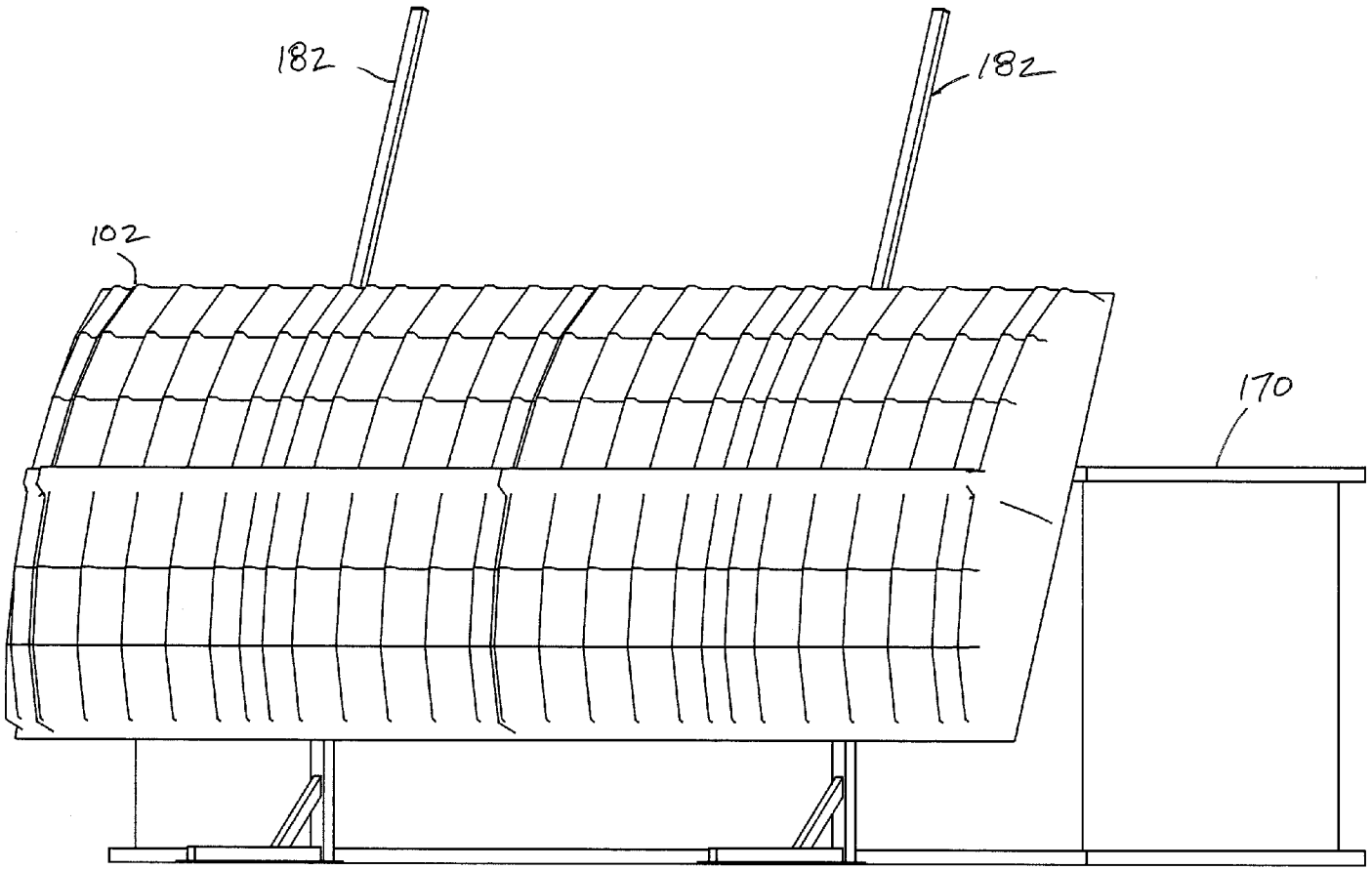
FIG. 13 is a perspective view of a cover assembly on a container, with a cover in between a closed position and an open position.
Figure 14:
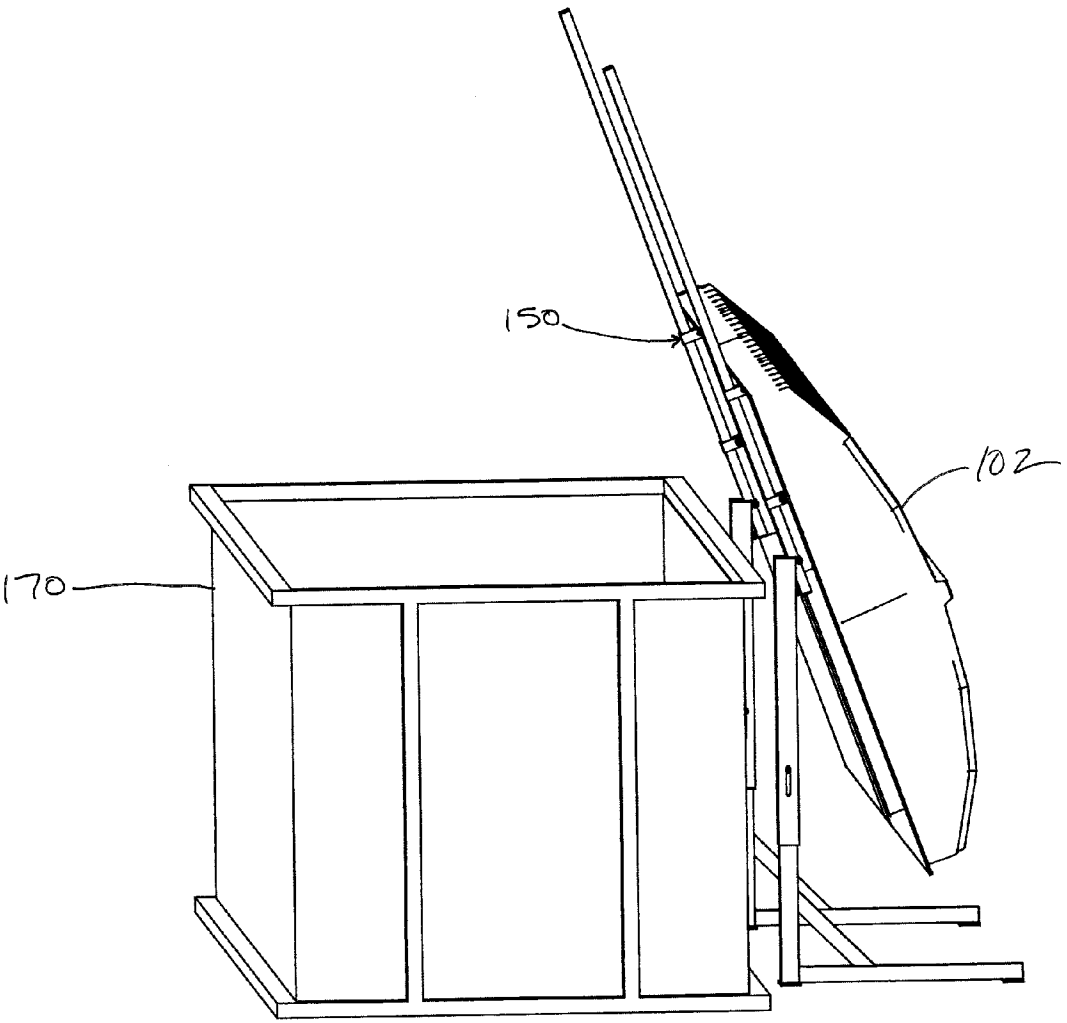
FIG. 14 is another view of the cover assembly of FIG. 13.

In operation, free-standing opening mechanism 180 performs similarly to the embodiments depicted in FIGS. 1-8. As frame 120 and cover 102 slide horizontally toward an open position, such as in FIGS. 9-10, once the middle of frame 120 and cover 102 are nearing the edge of container 170 (and therefore pivot 148 on opening mechanism 140), frame 120 and cover 102 will begin to be balanced over the pivot point. Continued movement toward the open position will cause frame 120 and cover 102 to move past the pivot point and begin to tilt from a horizontal orientation toward a vertical orientation, such as depicted in FIGS. 13-14. Mounting brackets 152 of opening mechanism 180 and the configuration of frame 120 act as stops, preventing frame 120 and cover 102 from sliding off of beams 142 and thereby container 170. Optionally, one or more counterweights may be added to frame 120 and/or handle in order to aid the opening of cover assembly 100.

The free-standing opening mechanism 180 is especially advantageous for use at permanent facilities which frequently fill containers, as cover assembly 100 may simply be opened such that cover 102 and frame 120 are out of the way, the container removed, and a new empty container placed next to cover assembly 100.

Various modifications to the embodiments of the inventions may be apparent to one of skill in the art upon reading this disclosure. For example, persons of ordinary skill in the relevant art will recognize that the various features described for the different embodiments of the inventions can be suitably combined, un-combined, and re-combined with other features, alone, or in different combinations, within the spirit of the invention. Likewise, the various features described above should all be regarded as example embodiments, rather than limitations to the scope or spirit of the inventions. Therefore, the above is not contemplated to limit the scope of the present inventions.

Persons of ordinary skill in the relevant arts will recognize that the inventions may comprise fewer features than illustrated in any individual embodiment described above. The embodiments described herein are not meant to be an exhaustive presentation of the ways in which the various features of the inventions may be combined. Accordingly, the embodiments are not mutually exclusive combinations of features; rather, the inventions may comprise a combination of different individual features selected from different individual embodiments, as understood by persons of ordinary skill in the art.

For purposes of interpreting the claims for the embodiments of the present inventions, it is expressly intended that the provisions of Section 112, sixth paragraph of 35 U.S.C. are not to be invoked unless the specific terms "means for" or "step for" are recited in a claim.

The invention claimed is:

1. A cover assembly for a container, comprising:
a frame;
a cover coupled to the frame;
an opening mechanism in communication with the frame and including a means for coupling with the container,
wherein the cover is configured to be movable between a closed position which substantially covers an opening of the container, and an open position which allows access to a substantial portion of the opening of the container; and
a roller assembly including at least one roller disposed between the frame and the opening mechanism,
wherein the roller assembly includes a bracket secured to the frame, the bracket configured to carry the at least one roller.

2. The cover assembly of claim 1, wherein the opening mechanism further includes a beam configured to substantially span the opening of the container.

3. The cover assembly of claim 2, wherein the opening mechanism further includes a hinge disposed between the beam and the means for coupling.

4. The cover assembly of claim 3, wherein the cover and the frame are configured to be slidable with respect to the beam of the opening mechanism in a first, generally horizontal direction to move the cover toward the open position.

5. The cover assembly of claim 4, wherein the cover and the frame are configured to pivot about the hinge so as to allow the cover and the frame to rotate from a generally horizontal orientation to a generally vertical orientation.

6. The cover assembly of claim 2, wherein the means for coupling is secured to a first side of the container, and wherein the a beam is configured to rest on a second side of the container when the cover assembly is in the closed position.

7. The cover assembly of claim 1, wherein the frame includes at least one longitudinal rail and at least one crossmember, the crossmember being generally transverse to the longitudinal rail.

8. The cover assembly of claim 1, wherein the opening mechanism further includes a hinge disposed between the beam and the means for coupling.

9. The cover assembly of claim 8, wherein the cover and the frame are configured to be slidable with respect to the beam of the opening mechanism in a first, generally horizontal direction to move the cover toward the open position.

10. The cover assembly of claim 9, wherein the cover and the frame are configured to pivot about the hinge so as to allow the cover and the frame to rotate from a generally horizontal orientation to a generally vertical orientation.

11. A kit for a cover assembly, comprising:
a plurality of support struts, the struts joined together to construct a frame;
a cover coupleable to the frame; and
an opening mechanism in communication with the frame and including a means for supporting the frame,
wherein the cover is configured to be movable between a closed position which substantially covers an opening of a container, and an open position which allows access to a substantial portion of the opening of the container; and a roller assembly including at least one roller disposed between the frame and the opening mechanism, wherein the roller assembly includes a bracket secured to the frame, the bracket configured to carry the at least one roller.

12. The kit of claim 11, wherein the frame includes at least one longitudinal rail and at least one lateral crossmember.

13. The kit of claim 11, wherein the cover includes a plurality of portions configured to be joined together.

14. The kit of claim 11, wherein the means for supporting the frame comprises a means for coupling to the container, and wherein the opening mechanism further includes a beam configured to substantially span the opening of the container and a hinge disposed between the beam and the means for coupling.

15. The kit of claim 11, wherein the means for supporting the frame comprises a support for coupling the cover assembly to a structure separate from the container, wherein the opening mechanism further includes a beam configured to substantially span the opening of the container and a hinge disposed between the beam and the support.

* * * * *